US008286954B2

(12) United States Patent
Zheng

(10) Patent No.: US 8,286,954 B2
(45) Date of Patent: Oct. 16, 2012

(54) LOCKING PLIERS WITH ONE OR TWO SLIDE BARS EACH SECURED TO A STATIONARY JAW CARRIER

(76) Inventor: Bo Ren Zheng, Taichung (TW)

( * ) Notice: Subject to any disclaimer, the term of this patent is extended or adjusted under 35 U.S.C. 154(b) by 452 days.

(21) Appl. No.: 12/728,272

(22) Filed: Mar. 22, 2010

(65) Prior Publication Data

US 2011/0227268 A1 Sep. 22, 2011

(51) Int. Cl.
*B25B 5/16* (2006.01)

(52) U.S. Cl. ..... 269/188; 269/3; 269/6; 29/268; 81/318

(58) Field of Classification Search ..... 269/188, 269/165–166, 3, 6, 95, 201, 204, 249, 143; 29/257, 268, 267; 81/309, 318, 427.5
See application file for complete search history.

(56) References Cited

U.S. PATENT DOCUMENTS 4,893,801 A * 1/1990 Flinn ..... 269/6
6,212,977 B1 * 4/2001 Liou ..... 81/323
6,973,859 B2 * 12/2005 Noniewicz ..... 81/320
7,007,936 B2 * 3/2006 Chang ..... 269/6
7,306,212 B2 * 12/2007 Cantin ..... 269/6
7,950,122 B2 * 5/2011 Saylor ..... 29/268
2005/0077666 A1 * 4/2005 Chang ..... 269/6
2005/0087918 A1 * 4/2005 Foshag et al. ..... 269/6
2006/0208407 A1 * 9/2006 Wang ..... 269/6
2007/0052145 A1 * 3/2007 Cantin ..... 269/6
2011/0227268 A1 * 9/2011 Zheng ..... 269/188

* cited by examiner

*Primary Examiner* — Lee D Wilson

(57) ABSTRACT

One embodiment of a locking pliers includes a first stationary jaw carrier comprising a first jaw at one end; a second stationary jaw carrier comprising a second jaw at one end; a bent first handle integrally formed with the first stationary jaw carrier; a bent second handle joined the first handle at a spring-actuated pivot joint and engaged with the other end of the second stationary jaw carrier; a self-adjusting locking unit disposed between the first and second handles and comprising a spring-actuated release lever; a locking assembly comprising a slide bar having one end fixedly secured to the other end of the second stationary jaw carrier and the other end inserting into a portion of the second handle between the pivot joint and the other end of the second stationary jaw carrier, and a spring-actuated release lever member lockingly put on the slide bar.

2 Claims, 8 Drawing Sheets

LOCKING PLIERS WITH ONE OR TWO SLIDE BARS EACH SECURED TO A STATIONARY JAW CARRIER

BACKGROUND OF THE INVENTION

1. Field of Invention

The invention relates to pliers and more particularly to a locking pliers having one or two slide bars each secured to a stationary jaw carrier, the slide bars being retracted in the handles when the pliers is not in use.

2. Description of Related Art

A typical pliers is shown in FIG. 9 and comprises a pair of handle 2, 3 joined at a fulcrum 4, a fixed first lever 5 at a front portion of the handle 2 and having a jaw 8, a slide bar 6 having one end fixedly secured to the handle 3 proximate the fulcrum 4, and a moveable second lever 7 slidably put on the slide bar 6 and having a jaw 9. In use, a user may pull the second lever 7 away from the first lever 5 or push the second lever 7 toward the first lever 5, place a work piece (not shown) in an opening between the jaws 8 and 9, and finally push the second lever 7 toward the first lever 5 to clamp the work piece.

While the typical pliers is adjustable by sliding the second lever 7, the slide bar 6 and the handle 3 are formed integrally. This is disadvantageous because the pliers is difficult of carrying due to the projecting slide bar 6. Thus, the need for improvement still exists.

SUMMARY OF THE INVENTION

It is therefore one object of the invention to provide a locking pliers comprising a first stationary jaw carrier comprising a first jaw at one end; a second stationary jaw carrier comprising a second jaw at one end; a bent first handle engaged with the other end of the first stationary jaw carrier; a bent second handle joined the first handle at a spring-actuated pivot joint and engaged with the other end of the second stationary jaw carrier; a self-adjusting locking unit disposed between the first and second handles and comprising a spring-actuated release lever; a first locking assembly comprising a first slide bar having one end fixedly secured to the other end of the first stationary jaw carrier and the other end inserting into a portion of the first handle between the pivot joint and the other end of the first stationary jaw carrier, and a spring-actuated first release lever member lockingly put on the first slide bar; and a second locking assembly comprising a second slide bar having one end fixedly secured to the other end of the second stationary jaw carrier and the other end inserting into the portion of the first handle between the pivot joint and the other end of the first stationary jaw carrier, and a spring-actuated second release lever member lockingly put on the second slide bar, the portion of the first handle between the pivot joint and the other end of the first stationary jaw carrier being partially engaged with inner surfaces of a portion of the second handle between the pivot joint and the other end of the second stationary jaw carrier.

The above and other objects, features and advantages of the invention will become apparent from the following detailed description taken with the accompanying drawings.

DETAILED DESCRIPTION OF THE INVENTION

Figure 1:
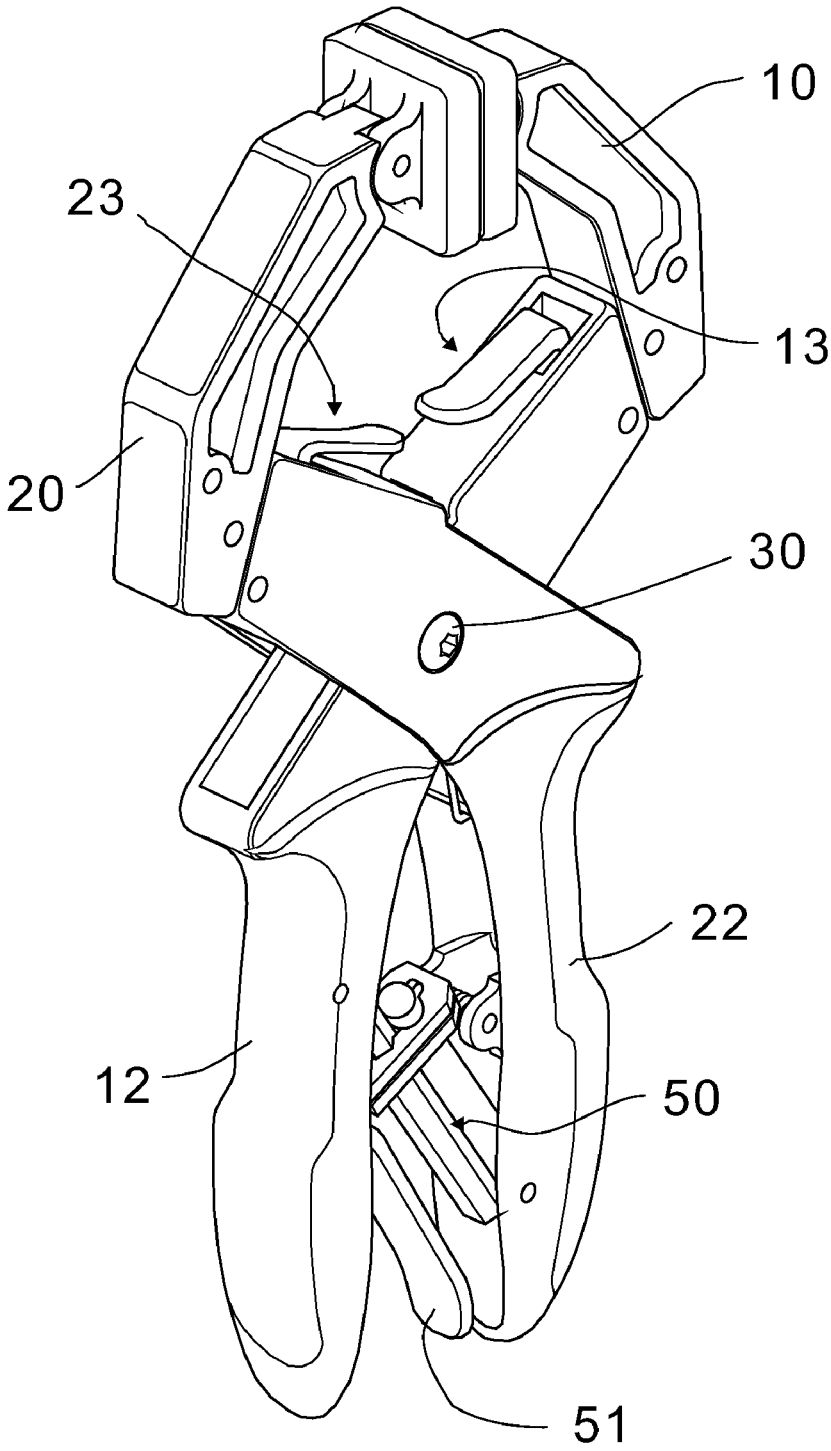
FIG. 1 is a perspective view of a locking pliers according to a first preferred embodiment of the invention.
Figure 2:
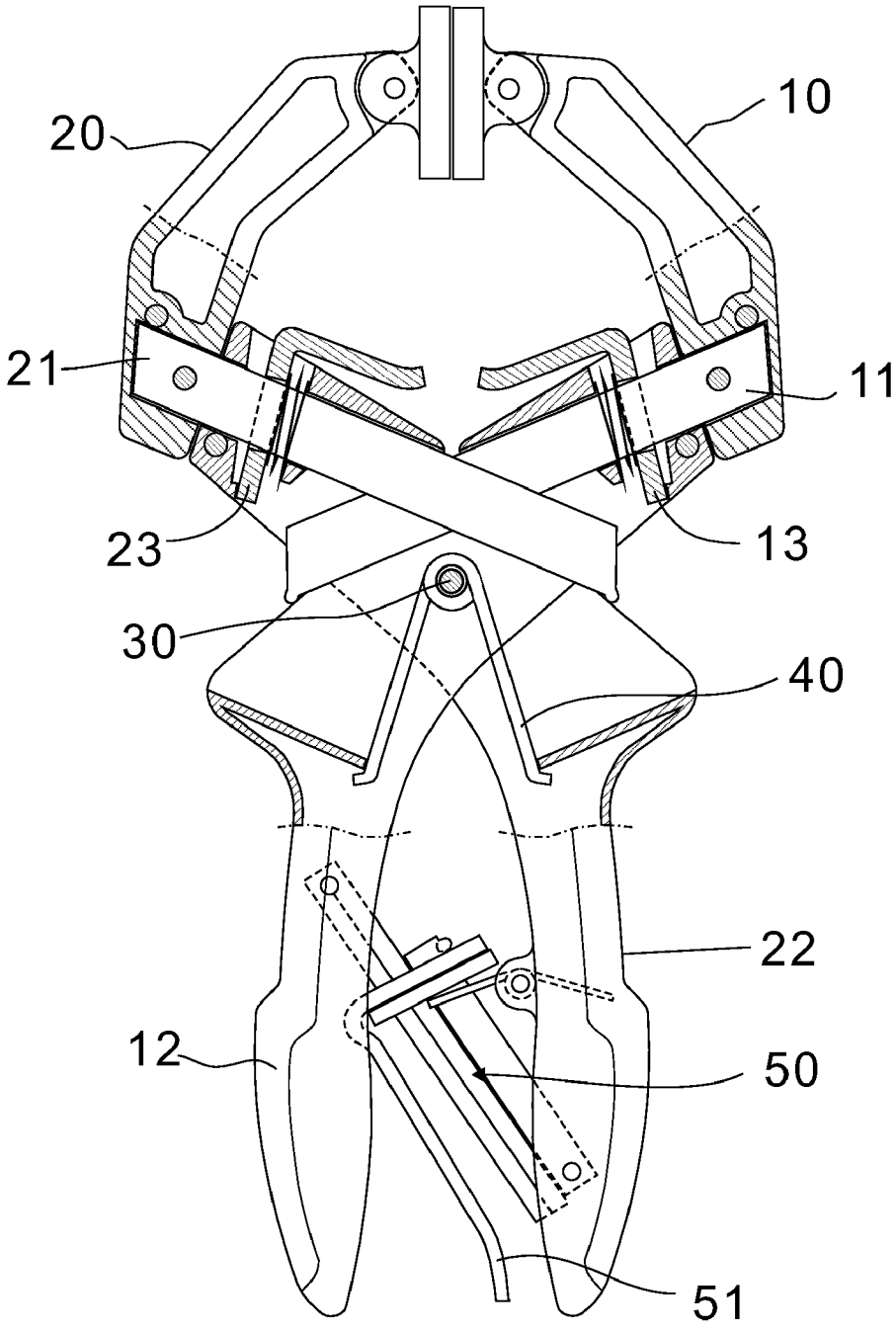
FIG. 2 is a schematic side elevation in part section of the locking pliers.
Figure 3:
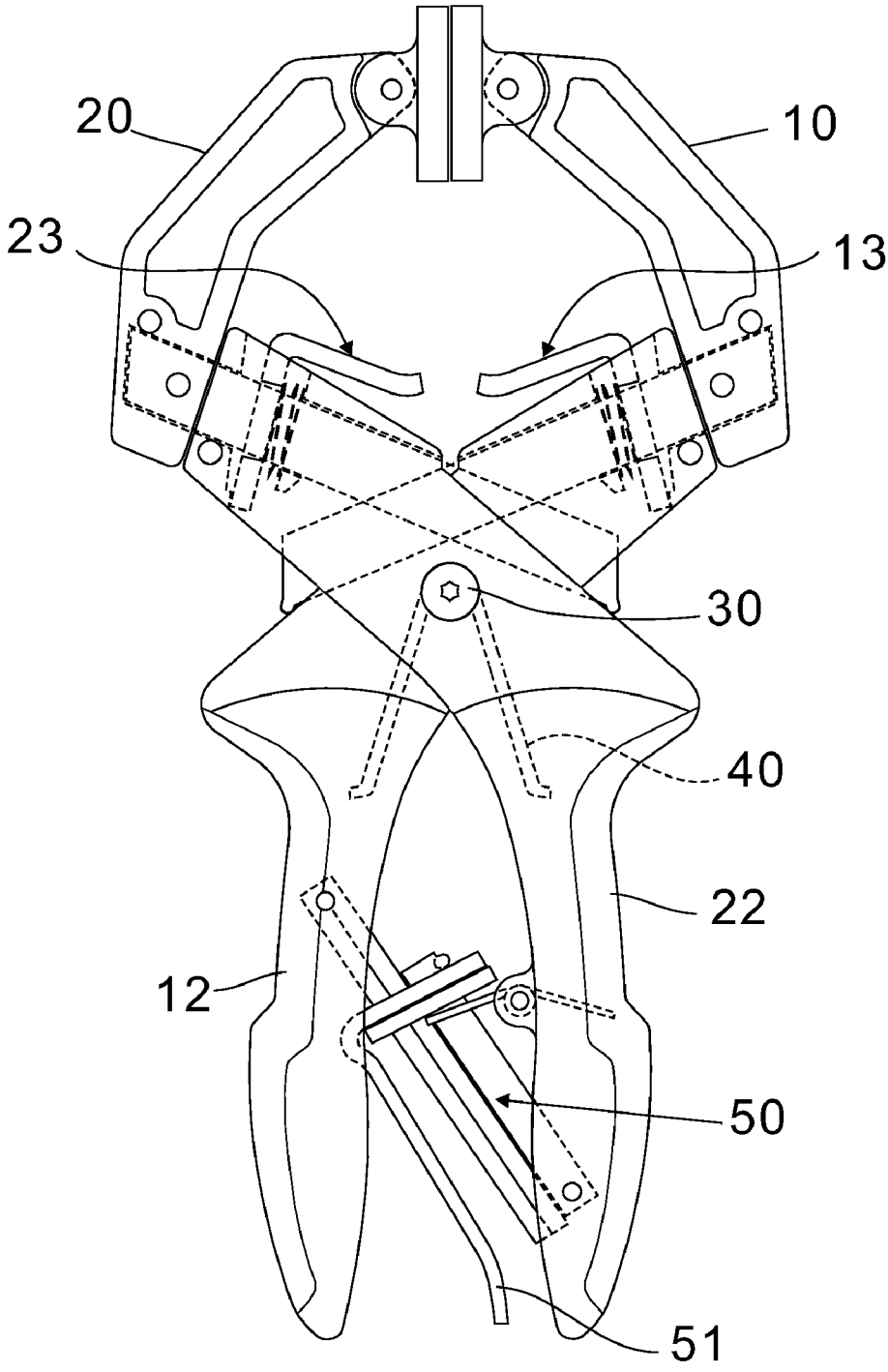
FIG. 3 is a schematic side elevation of the locking pliers.
Figure 4:
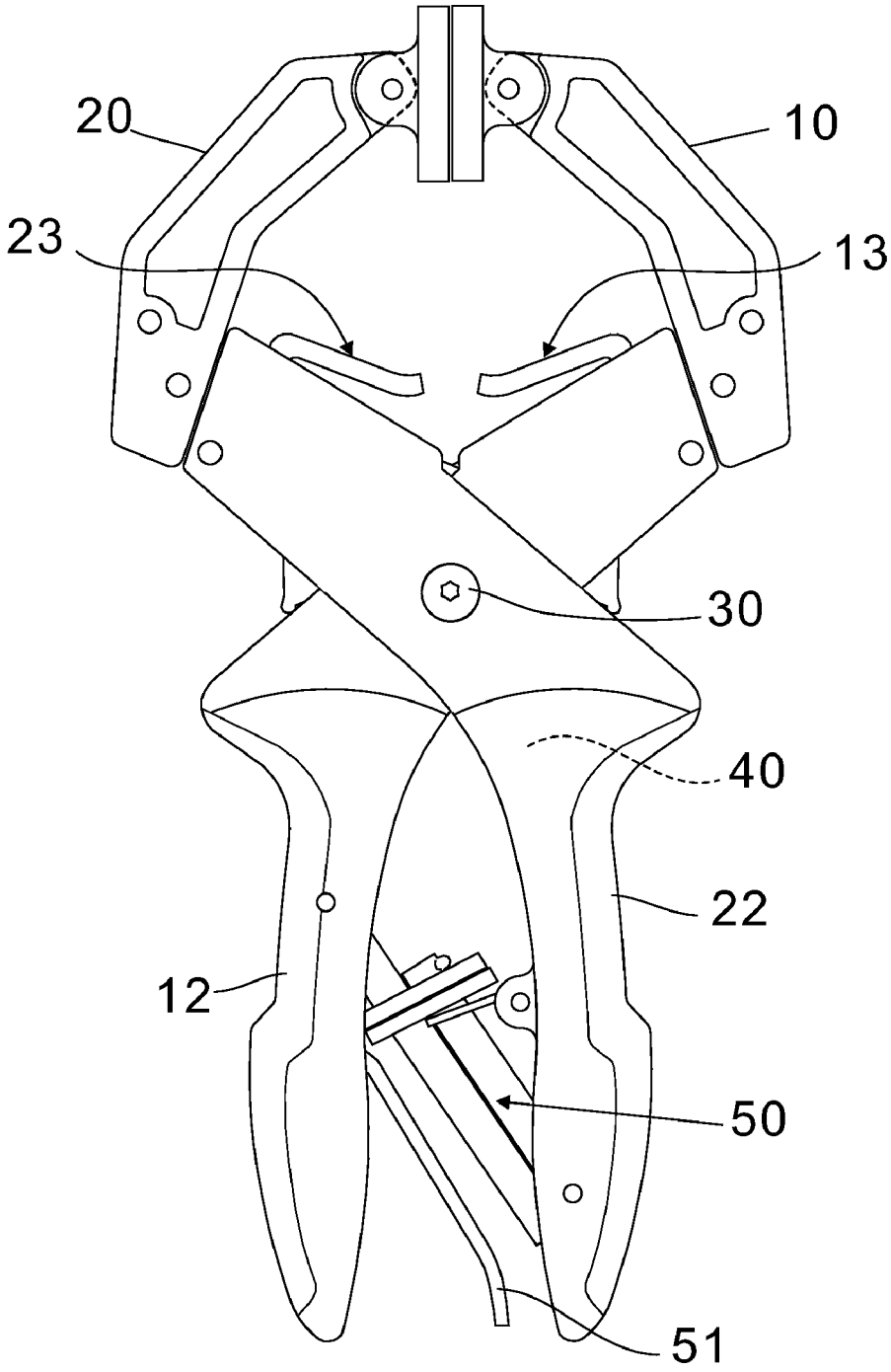
FIG. 4 is a side elevation in part section of the locking pliers.
Figure 6:
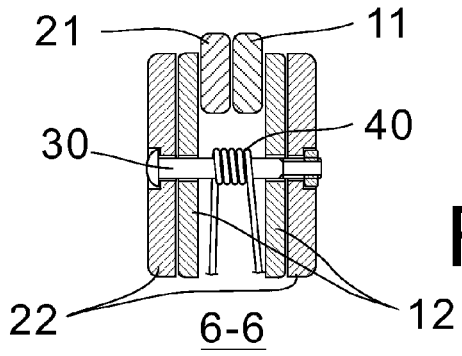
FIG. 6 is a sectional view taken along line 6-6 of FIG. 5.
Figure 5:
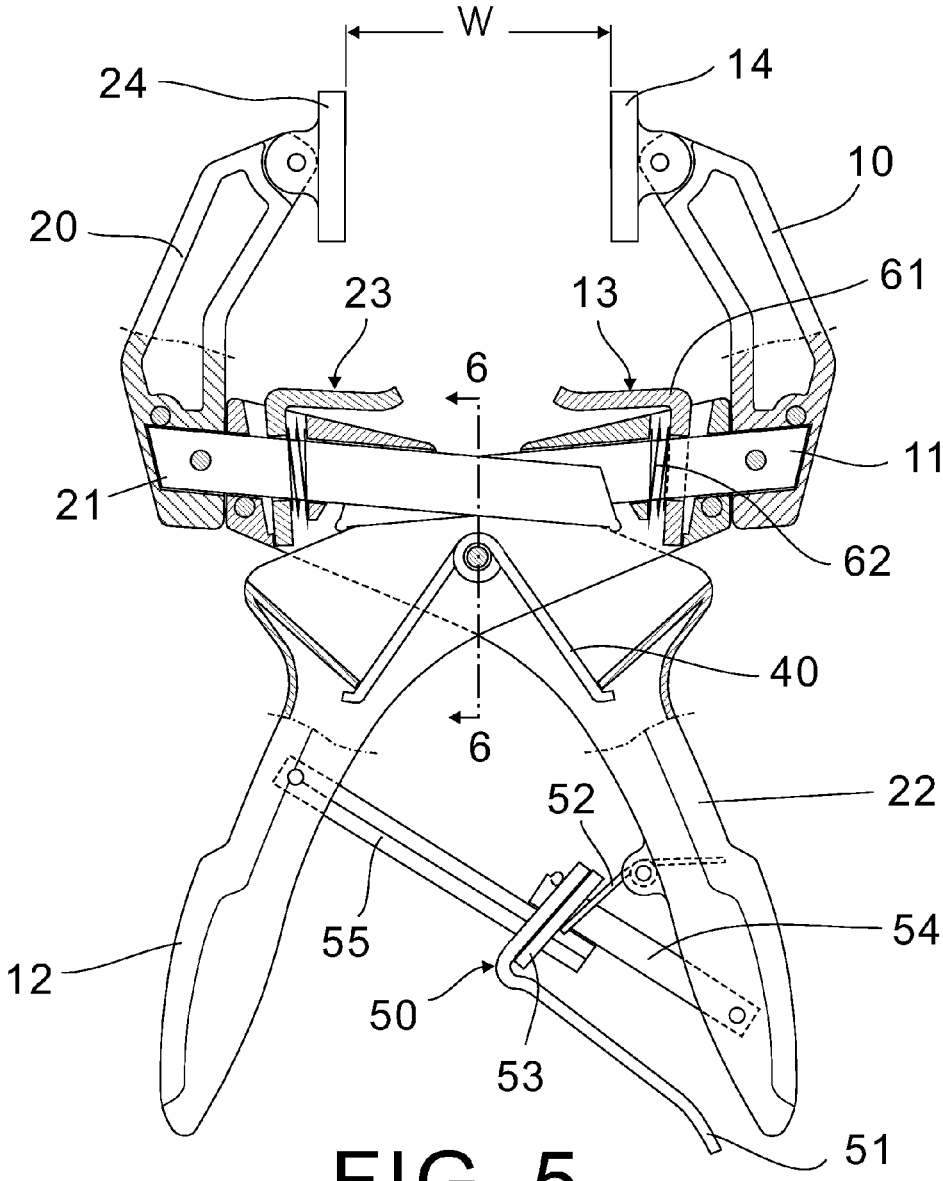
FIG. 5 is a view similar to FIG. 2 where the jaws are open.

Referring to FIGS. 1 to 7, a locking pliers in accordance with the invention comprises the following components as discussed in detail below.

A first stationary jaw carrier 10 has a pivotal jaw 14 at one end. A second stationary jaw carrier 20 has a pivotal jaw 24 at one end. A bent first handle 12 and a bent second handle 22 are joined at a pivot joint 30 which is mounted with a torsion spring 40. The spring 40 has both ends anchored in two inner members of the first and second handles 12, 22 respectively so that the first and second handle 12, 22 can be resiliently pressed together.

A self-adjusting locking unit 50 is provided between the first and second handles 12, 22 and comprises a torsion spring 52 mounted on an inner surface of the second handle 22, a first bar 54 having one end pivotably secured to the inner surface of the second handle 22, a release lever 51 mounted on the other end of the first bar 54, a plate 53 urged between the other end of the spring 52 and a section of the release lever 51, and a second bar 55 having one pivotably secured to the inner surface of the first handle 11 and the other end slidably inserting through the section of the release lever 51 and the plate 53 to dispose engage with the first bar 54 thereabove. The self-adjusting locking unit 50 is locked with the jaws 14, 24 being engaged.

A housing portion of the first handle 12 extending from the pivot joint 30 has its end engaged with the other end of the first stationary jaw carrier 10 and a housing portion of the second handle 22 extending from the pivot joint 30 has its end engaged with the other end of the second stationary jaw carrier 20. The housing portion of the first handle 12 is partially engaged with inner surfaces of a portion of the housing portion of the first handle 22.

A first locking assembly 13 comprises a first slide bar 11 having one end fixedly secured to the other end of the first stationary jaw carrier 10 and the other end inserting into the housing portion of the first handle 12, a bent release lever member 61 having a holed portion put on the first slide bar 11 and an exposed portion for manual manipulation, and a torsion spring 62 biased between an internal member of the housing portion of the first handle 12 and the holed portion of the release lever member 61 for retaining the holed portion of the release lever member 61 in the housing portion of the first handle 12.

A second locking assembly 23 comprises a second slide bar 21 having one end fixedly secured to the other end of the second stationary jaw carrier 20 and the other end inserting into the housing portion of the first handle 12, a bent release lever member 61 having a holed portion put on the second slide bar 21 and an exposed portion for manual manipulation, and a torsion spring 62 biased between an internal member of the housing portion of the second handle 22 and the holed portion of the release lever member 61 for retaining the holed portion of the release lever member 61 in the housing portion of the second handle 22.

In an inoperative position, both the first and second slide bars 11, 21 are locked by the release lever members 61 and the jaws 14, 24 are engaged. In use, a person may press the release lever 51 to unlock the self-adjusting locking unit 50. As a result, the first and second handles 12, 22 are pushed apart by the springs 52 and 40. Also, the jaws 14, 24 are open and separated by a distance W (see FIG. 5).

Figure 7:
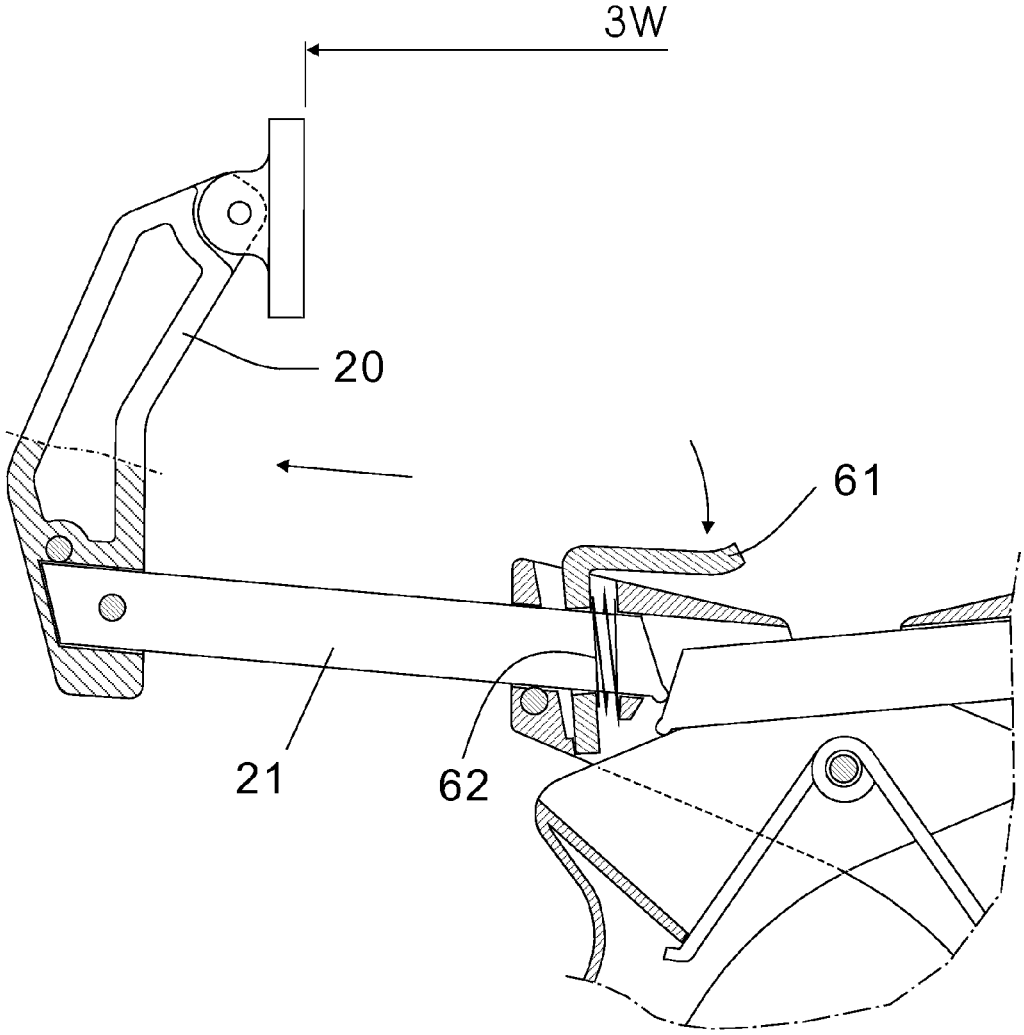
FIG. 7 is a fragmentary view of the left upper portion of FIG. 5 with the slide bar being pulled a distance.

Moreover, the person may press the release lever member(s) 61 to unlock the first locking assembly 13 and/or the second locking assembly 23 to further increase the distance. For example, as shown in FIG. 7, the person may press the exposed portion of the release lever member 61 to unlock the second locking assembly 23. Then the person may freely pull the second stationary jaw carrier 20 away from the housing portion of the second handle 22 (as indicated by arrow) until a desired distance (e.g., 3W as shown) between the jaws 14 and 24 is reached. After releasing the exposed portion of the release lever member 61, the release lever member 61 is immediately locked by urging the release lever member 61 against the second slide bar 21 as the spring 62 expands. As a result, the second locking assembly 23 is locked again.

Figure 8:
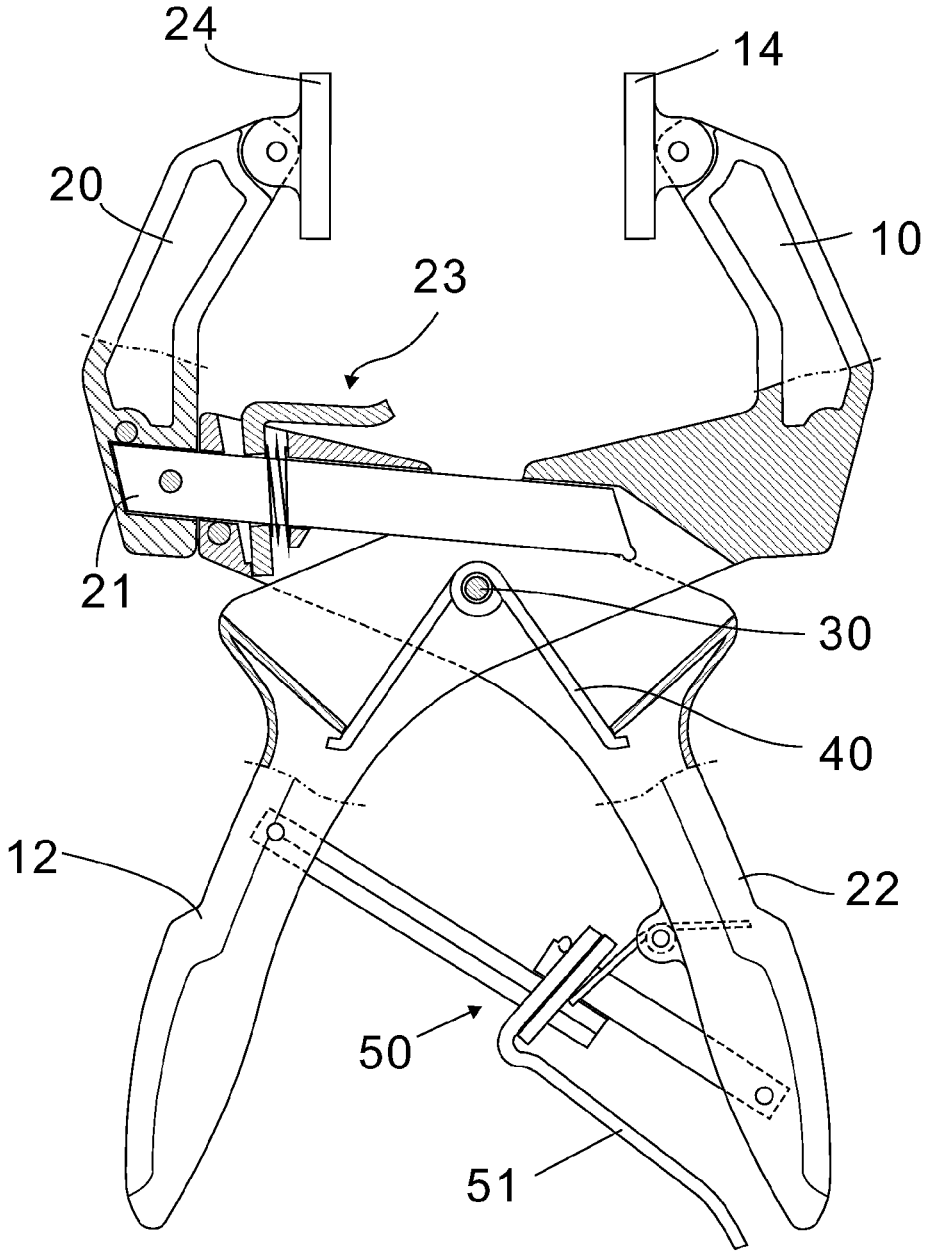
FIG. 8 is a side elevation in part section of a locking pliers according to a second preferred embodiment of the invention.
Figure 9:
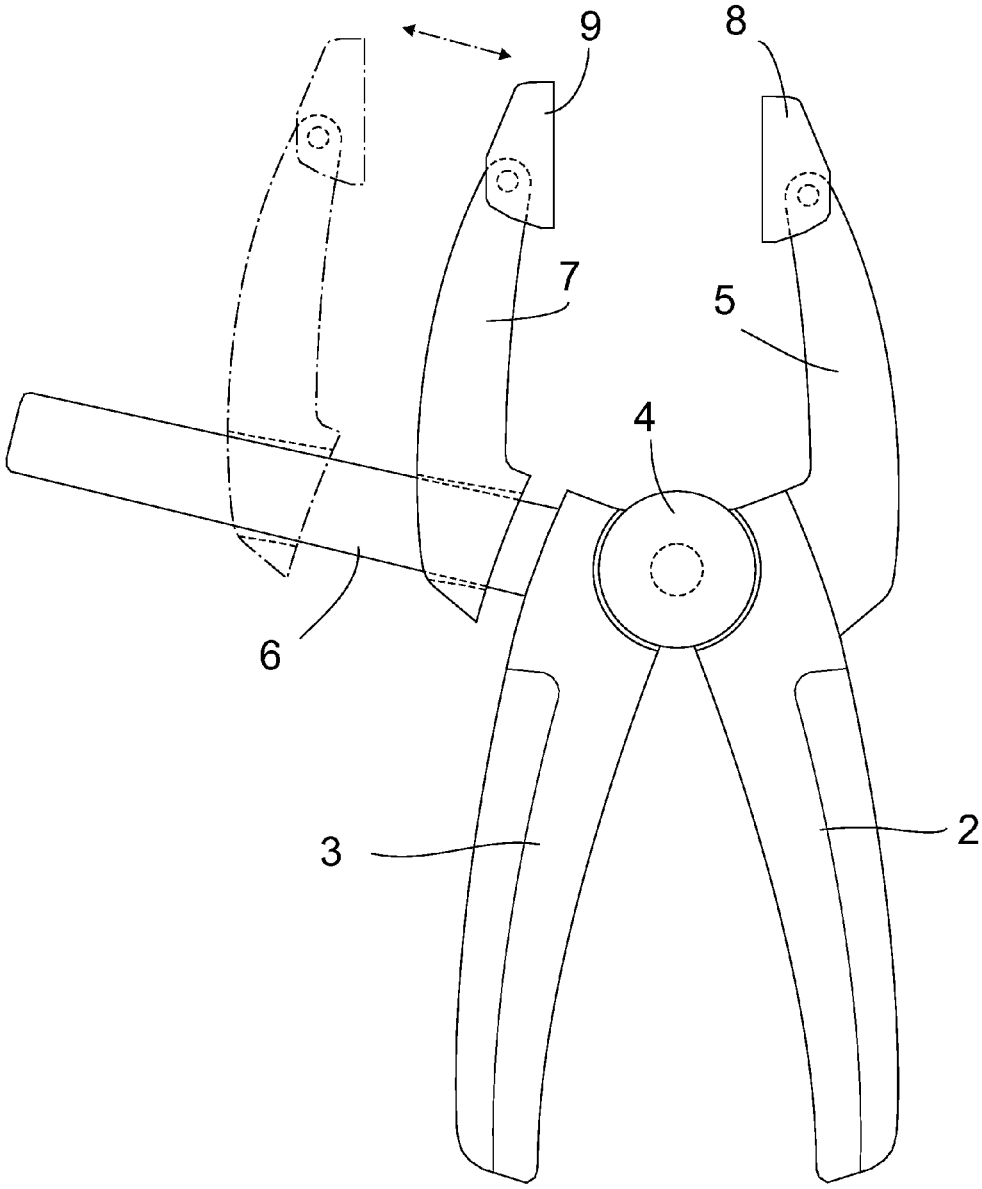
FIG. 9 PRIOR ART
FIG. 9 is a side elevation of a typical pliers.

Referring to FIG. 8, a locking pliers according to a second preferred embodiment of the invention is shown. The locking pliers of the second preferred embodiment has the following characteristics.

A first stationary jaw carrier 10 has a pivotal jaw 14 at one end. A second stationary jaw carrier 20 has a pivotal jaw 24 at one end. A bent first handle 12 and a bent second handle 22 are joined at a pivot joint 30 which is mounted with a torsion spring 40. The spring 40 has both ends anchored in two inner members of the first and second handles 12, 22 respectively so that the first and second handle 12, 22 can be resiliently pressed together.

A self-adjusting locking unit 50 is provided between the first and second handles 12, 22 and comprises a spring-actuated release lever 51 for manual manipulation for unlocking. A housing portion of the first handle 12 extending from the pivot joint 30 is integrally formed with the first stationary jaw carrier 10 and a housing portion of the second handle 22 extending from the pivot joint 30 has its end fixedly secured to the other end of the second stationary jaw carrier 20.

A spring-actuated locking assembly 23 comprises a slide bar 21 having one end fixedly secured to the other end of the second stationary jaw carrier 20 and the other end inserting into the housing portion of the second handle 22.

In an inoperative position, the slide bars 21 is locked by the locking assembly 23 and the jaws 14, 24 are engaged. In use, a person may press the release lever 51 to unlock the self-adjusting locking unit 50. As a result, the first and second handles 12, 22 are pushed apart by at least the expanding spring 40. Also, the jaws 14, 24 are open.

Moreover, the person may manually unlock the locking assembly 23. Then the person may freely pull the second stationary jaw carrier 20 away from the housing portion of the second handle 22 until a desired distance between the jaws 14 and 24 is reached. After releasing the locking assembly 23, the slide bar 21 is locked again.

While the invention herein disclosed has been described by means of specific embodiments, numerous modifications and variations could be made thereto by those skilled in the art without departing from the scope and spirit of the invention set forth in the claims.

What is claimed is:

1. A locking pliers comprising:

a first stationary jaw carrier comprising a first jaw at one end;

a second stationary jaw carrier comprising a second jaw at one end;

a bent first handle engaged with the other end of the first stationary jaw carrier;

a bent second handle joined the first handle at a spring-actuated pivot joint and engaged with the other end of the second stationary jaw carrier;

a self-adjusting locking unit disposed between the first and second handles and comprising a spring-actuated release lever;

a first locking assembly comprising a first slide bar having one end fixedly secured to the other end of the first stationary jaw carrier and the other end inserting into a portion of the first handle between the pivot joint and the other end of the first stationary jaw carrier, and a spring-actuated first release lever member lockingly put on the first slide bar; and a second locking assembly comprising a second slide bar having one end fixedly secured to the other end of the second stationary jaw carrier and the other end inserting into the portion of the first handle between the pivot joint and the other end of the first stationary jaw carrier, and a spring-actuated second release lever member lockingly put on the second slide bar, the portion of the first handle between the pivot joint and the other end of the first stationary jaw carrier being partially engaged with inner surfaces of a portion of the second handle between the pivot joint and the other end of the second stationary jaw carrier, wherein in an inoperative position, the self-adjusting locking unit is locked, the first and second jaws are engaged, and both the first and second slide bars are locked by the first and second release lever members respectively; and wherein in response to pressing the release lever to unlock the self-adjusting locking unit, the first and second handles are pushed apart and the first and second jaws separated by a distance;

wherein in response to pressing the first release lever member to unlock the first locking assembly, the first slide bar is adapted to pull away from the first handle to further separate the first jaw from the second jaw; and wherein in response to pressing the second release lever member to unlock the second locking assembly, the second slide bar is adapted to pull away from the second handle to further separate the second jaw from the first jaw.

2. A locking pliers comprising:

a first stationary jaw carrier comprising a first jaw at one end;

a second stationary jaw carrier comprising a second jaw at one end;

a bent first handle integrally formed with the first stationary jaw carrier;

a bent second handle joined the first handle at a spring-actuated pivot joint and engaged with the other end of the second stationary jaw carrier;

a self-adjusting locking unit disposed between the first and second handles and comprising a spring-actuated release lever;

a locking assembly comprising a slide bar having one end fixedly secured to the other end of the second stationary jaw carrier and the other end inserting into a portion of the second handle between the pivot joint and the other end of the second stationary jaw carrier, and a spring-actuated release lever member lockingly put on the slide bar, wherein in an inoperative position, the self-adjusting locking unit is locked, the first and second jaws are engaged, and the slide bar is are locked by the release lever member; and wherein in response to pressing the release lever to unlock the self-adjusting locking unit, the first and second handles are pushed apart and the first and second jaws separated by a distance; and wherein in response to pressing the release lever member to unlock the locking assembly, the slide bar is adapted to pull away from the second handle to further separate the second jaw from the first jaw.

* * * * *